US007112769B2

(12) United States Patent
Del Regno

(10) Patent No.: US 7,112,769 B2
(45) Date of Patent: Sep. 26, 2006

(54) SUSCEPTOR FOR HYBRID MICROWAVE SINTERING SYSTEM, HYBRID MICROWAVE SINTERING SYSTEM INCLUDING SAME AND METHOD FOR SINTERING CERAMIC MEMBERS USING THE HYBRID MICROWAVE SINTERING SYSTEM

(75) Inventor: Gary Eugene Del Regno, Honeoye Falls, NY (US)

(73) Assignee: Alfred University, Alfred, NY (US)

( * ) Notice: Subject to any disclaimer, the term of this patent is extended or adjusted under 35 U.S.C. 154(b) by 0 days.

(21) Appl. No.: 10/966,467

(22) Filed: Oct. 15, 2004

(65) Prior Publication Data

US 2006/0016805 A1 Jan. 26, 2006

Related U.S. Application Data

(60) Provisional application No. 60/531,742, filed on Dec. 22, 2003, provisional application No. 60/514,871, filed on Oct. 27, 2003.

(51) Int. Cl.
*H05B 6/80* (2006.01)

(52) U.S. Cl. ..... 219/680; 219/579

(58) Field of Classification Search ..... 219/679, 219/680, 730, 751, 754, 759; 118/725, 728, 118/730, 719, 723 E, 500; 156/345.24; 427/534; 134/1, 19, 158

See application file for complete search history.

(56) References Cited

U.S. PATENT DOCUMENTS 6,512,216 B1 * 1/2003 Gedevanishvili et al. ... 219/759
6,710,315 B1 * 3/2004 Chisholm ..... 219/730
6,744,028 B1 * 6/2004 Chisholm et al. ..... 219/730

* cited by examiner

*Primary Examiner*—Quang Van
(74) *Attorney, Agent, or Firm*—Burr & Brown

(57) ABSTRACT

A susceptor for a microwave hybrid heating system is provided, including a hollow member made of a heat resistant material that does not substantially absorb or reflect microwave energy at room temperature and a substance contained within the hollow member. The substance substantially immediately couples to microwave energy at room temperature to form a plasma that emits radiant energy substantially immediately. A microwave hybrid heating system and a continuous microwave hybrid heating system including at least one susceptor according to the present invention are provided, as well as a method for sintering ceramic members using a microwave hybrid heating system according to the present invention.

25 Claims, 3 Drawing Sheets

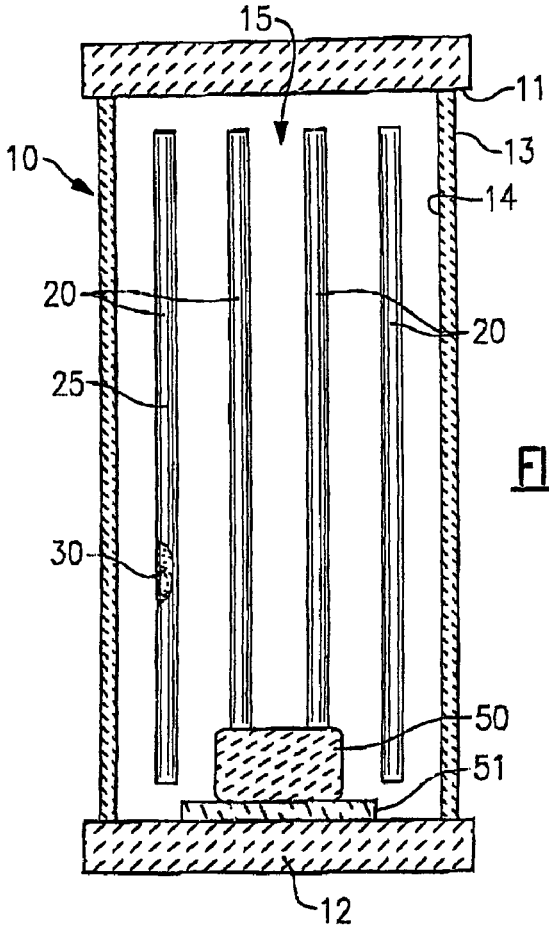
FIG.3A
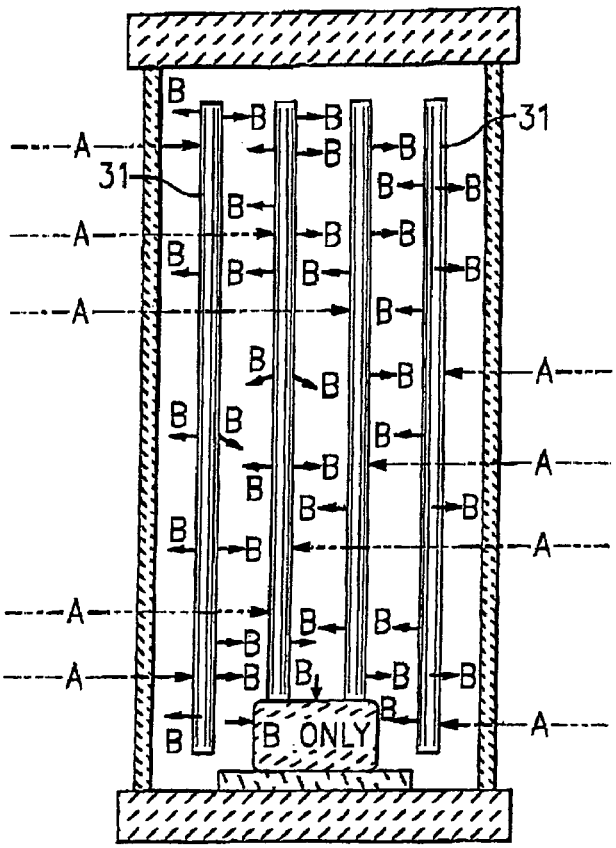
FIG.3B
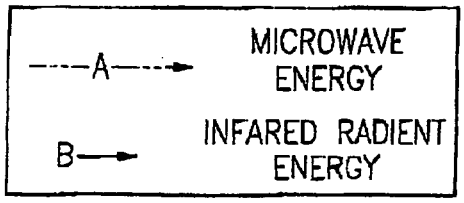

SUSCEPTOR FOR HYBRID MICROWAVE SINTERING SYSTEM, HYBRID MICROWAVE SINTERING SYSTEM INCLUDING SAME AND METHOD FOR SINTERING CERAMIC MEMBERS USING THE HYBRID MICROWAVE SINTERING SYSTEM

CROSS REFERENCE TO RELATED APPLICATION

This application claims the benefit of U.S. Provisional Application Ser. Nos. 60/514,871 filed Oct. 27, 2003 and Ser. No. 60/531,742 filed Dec. 22, 2003, the entireties of which are incorporated herein by reference.

FIELD OF THE INVENTION

The present invention relates to a susceptor for a microwave hybrid heating system, a microwave hybrid heating system including such a susceptor, and a method for sintering ceramic materials in such a hybrid microwave heating system.

BACKGROUND OF THE INVENTION

Microwave energy offers a fast and effective sintering process that can reduce processing time by over 50% and which offers energy savings as a result. These decreased processing times and energy savings associated with microwave sintering, however, can only be applied to materials that can be readily processed by microwaves. The applicability of direct microwave sintering to specific materials is based on the characteristics of the material, that is, whether the dielectric constant and the dielectric loss of the material are such that the material will respond to microwave energy at a specific microwave frequency.

The specific frequency at which a given material will most effectively couple directly with microwave energy is dictated by the complex permittivity characteristics of that material. That is, when a material having a suitable dielectric constant and dielectric loss factor is irradiated with microwaves at a specific frequency, the material will absorb, store, and transform the microwave energy into thermal energy. This behavioral phenomenon in materials is often referred to as susceptibility. The susceptibility of a given material generally increases with temperature, as the dielectric loss factor of the material increases. Susceptibility in some materials diminishes, however, at a certain temperature where the dielectric loss of the material becomes sufficiently high enough such that the same material becomes reflective to microwave energy, even at an elevated temperature.

Near room temperature susceptibility is a desired property for materials to be sintered using microwave energy. Many ceramic materials, however, such as $SiO_2$, $Al_2O_3$ and $ZrO_2$, have a low room temperature dielectric loss factor and are virtually transparent to microwaves at room temperature, that is, these materials do not substantially reflect or absorb microwaves. As such, these materials do not directly couple with microwaves at room temperature. Indeed, sintering ceramic materials using direct microwave systems has been problematic if not impossible since most ceramic materials are not readily susceptible to microwaves emitted at a frequency of 2.45 GHz, which is a commercially desirable microwave frequency for materials processing.

That is, the Federal Communication Commission (FCC) has allocated specific uses for all frequencies ranging from 300 MHz to 300 GHz, including applications such as communications, avionics, and naval and other military applications, including radar, satellite, and missile guidance applications. Additionally, all non-military communications, including wireless and cellular communication systems, satellite television, household appliances, and scientific frequencies have been specifically allocated, as well. Large-scale use of any frequency outside of the specific use allocation range detrimentally interferes with the intended applications allocated to the specific frequency range. Accordingly, only those frequencies that have been specifically designated for scientific, industrial, and household use would be suited for material processing with microwaves. As such, viable microwave processes for those applications are limited to the frequencies allocated by the FCC.

In general, microwave technologies have been restricted to frequencies of 2.45, 5.8, 10, 18, 28, 84 and 110 GHz operating systems. Generally speaking, however, higher operating frequencies require a more expensive operating system. For example, in microwave processes involving lower frequencies or lower power requirements, such as power requirements less than 20 KW, magnetron technology is most often used to generate the microwaves. As the power requirements increase, however, more suitable microwave generation sources become klystrons, gyrotrons and gyroklystrons etc., the system costs of which can easily exceed $500,000.

As a source for microwave generation, magnetron technology is generally well understood and has been well developed. That is, since the advent of the household microwave oven, the focus on cost reductions through "economies of scale" has allowed the market to develop to such a degree that more than 60 million household microwave ovens are produced per year, each of which operates at a frequency of 2.45 GHz using a magnetron source. Thus, microwave processing systems with 2.45 GHz magnetron microwave sources are by far the most economical and readily attainable type of microwave sintering system.

As mentioned above, however, most materials, and particularly, most ceramic materials, are not readily susceptible to microwaves emitted at a frequency of 2.45 GHz at room temperature. Increasing the microwave processing frequency involves a correlating increase in operational expense, and does not necessarily guarantee an energy efficient room temperature response from low dielectric loss (low susceptibility) ceramic materials. Therefore, a material having a high room temperature susceptibility is required to be used in concert with the low susceptibility material to be sintered in order to even make microwave sintering low susceptibility materials at a frequency of 2.45 GHz a possibility. Hybrid microwave sintering involves such a combination.

In hybrid microwave sintering, a high susceptibility material (primary material) is provided that readily couples to and absorbs the microwave energy and transforms it into infrared energy, which is emitted from the primary material to heat a low susceptibility (secondary) material to be sintered. That is, the primary material, also known as a susceptor, responds to microwave energy at room temperature to become an infrared radiant heater. As the temperature of the secondary material increases as a result of the heat emitted from the primary material, the susceptibility of the secondary material increases until the material can directly absorb and couple with the microwave energy. That is, the secondary material responds to the radiant energy of the primary susceptor material until the temperature at which the secondary material can couple directly to the microwave radiation is reached.

There are, however, drawbacks associated with microwave hybrid heating systems. One problem is that the masses of the susceptible materials are included as an integral part of the materials sintering process, in that the susceptor mass required to radiate a sufficient amount of infrared energy to induce microwave coupling in the material to be sintered becomes an energy consumption consideration. That is, for a specific mass of any given susceptor material, a certain amount of energy input is required in order for the susceptor material to begin radiating heat and in order to increase and maintain the desired level of heat output therefrom. Typically, a large load or a high mass secondary material requires a correspondingly larger mass for the susceptor. In that manner, the susceptor material can act as a thermal well that diminishes the energy efficiency of the overall system.

While the physical space that the susceptor material occupies can be reduced, for example, by reducing the profile of the susceptor or by designing the susceptor material to act as a setter material for the load, a certain amount of energy input is still required in order for the susceptor material to begin radiating heat and to increase and maintain the desired level of heat output. Further, in the case of most solid-state susceptor materials, reducing the mass of the susceptor material may undesirably inhibit the ability of the susceptor to emit enough radiant heat to bring the mass of the secondary material to the coupling-trigger temperature.

Thus, it would be desirable to provide a commercially viable microwave sintering system that addresses the problems currently associated with microwave sintering systems. That is, it would be desirable to provide a hybrid microwave sintering system that can effectively sinter a large material load using an economic, commercially available microwave furnace with a standard 2.45 GHz frequency magnetron source. In conjunction therewith, it would also be desirable to provide a relatively low mass susceptor that can provide a sufficient amount of radiated infrared heat to adequately heat a large load with a low overall microwave energy input and high energy efficiency. It would also be desirable to provide a method for microwave sintering low loss materials, such as ceramic materials, using an energy efficient hybrid microwave heating system.

SUMMARY OF THE INVENTION

It is an object of the present invention to overcome the drawbacks described above. It is also an object of the present invention to provide a hybrid microwave sintering system that can effectively sinter a large material load using an economic, commercially available microwave furnace with a standard 2.45 GHz frequency magnetron source. In conjunction therewith, it is an object of the present invention to provide a relatively low mass susceptor that provides a sufficient amount of radiated infrared heat to adequately heat a large load with a low overall microwave energy input and high energy efficiency. It is also an object of the present invention to provide a method for microwave sintering low loss materials, such as ceramic materials, using an energy efficient hybrid microwave heating system.

According to one embodiment of the present invention, a susceptor for a microwave hybrid heating system is provided. The susceptor includes a hollow member surrounding a substance contained within the hollow member that substantially immediately couples to microwave energy at room temperature and emits radiant energy substantially immediately. Preferably, the hollow member comprises a ceramic envelope made of a heat resistant material that does not substantially absorb or reflect microwave energy at room temperature.

The ceramic envelope preferably comprises at least one material selected form the group consisting of quartz, translucent polycrystalline alumina, single crystal magnesium oxide, single crystal sapphire, cubic zirconia and yttrium oxide.

The substance contained within the ceramic envelope preferably substantially immediately forms a plasma when the susceptor is irradiated with microwave energy, and preferably comprises a gas, more preferably a noble gas, having a sufficient volume and a sufficient pressure to ensure safe and sufficient radiant energy emission when the susceptor is irradiated with microwave energy.

A main feature of the invention is containing a plasma within a ceramic envelope to provide a susceptor for a MHH system such that the load to be sintered is provided outside the plasma field. That is, by using a quick-response susceptor comprising a gas-filled ceramic envelope according to the present invention, several major benefits are achieved, as discussed below.

First, the overall mass of the susceptor required for a specified level of radiant heat output is reduced because the mass of the substance contained within the microwave transparent vessel (hollow member) is significantly less than that of a solid state susceptor material. Additionally, the substance interacts with the microwave energy and produces a heat-emitting plasma substantially immediately. In that manner, the energy transfer between the microwave energy and the substance is virtually direct. Further, plasma generates heat at a much higher rate of speed when compared to solid state radiant heat transfer. Moreover, since the energy transfer between the microwaves and the substance is substantially direct and virtually instantaneous, very little energy is lost compared to the energy loss associated with first heating a solid state susceptor material to a radiant temperature and the continued energy input required to maintain the radiant emissions of the solid state susceptor during sintering.

According to another embodiment of the present invention, a method for sintering a ceramic member using microwave hybrid heating system is provided. The method includes the steps of:

(a) providing at least one ceramic member to be sintered comprising a material having a microwave coupling-trigger temperature greater than room temperature;

(b) providing a microwave furnace including an applicator in communication with at least one microwave source, the applicator having a microwave chamber lined with a material that reflects microwave energy;

(c) providing a thermal containment unit comprising a material that does not substantially absorb or reflect microwave energy at room temperature or at any temperature less than a maximum sintering temperature of the ceramic member to be sintered, the thermal containment unit having an inner surface and an outer surface defining a thermal containment chamber;

(d) providing at least one susceptor, the susceptor comprising a heat resistant hollow member and a substance contained within the hollow member, the substance comprising a material that substantially immediately couples to microwave energy at room temperature and emits radiant energy substantially immediately;

(e) positioning the susceptor within the thermal containment chamber of the thermal containment unit;

(f) positioning the ceramic member to be sintered within the containment chamber of the thermal containment unit;

(g) positioning the thermal containment unit within the microwave chamber of applicator;

(h) irradiating the microwave chamber with microwave energy from the microwave source; and (i) sintering the ceramic member.

The substance contained within the hollow member substantially immediately couples to the microwave energy in step (h) such that the susceptor emits radiant energy substantially immediately and the temperature of the ceramic member within the thermal containment chamber is raised via the radiant energy emitted from the susceptor to the microwave coupling-trigger temperature of the ceramic member, at which time the ceramic member directly couples to the microwave energy such that the ceramic member is sintered by the microwave energy in cooperation with the radiant energy emitted from the susceptor.

Preferably, a plurality of the susceptors are provided in step (d) and positioned adjacent and proximate peripheral portions of the inner peripheral surface of the thermal containment unit in step (e) so as to substantially peripherally surround the ceramic member when the ceramic member is positioned in step (f).

According to yet another embodiment of the present invention, a microwave hybrid heating system is provided. The system includes a microwave furnace including an applicator in communication with at least one microwave source, the applicator having a microwave chamber lined with a material that reflects microwave energy, and a thermal containment unit provided within the microwave chamber of the applicator. The thermal containment unit comprises a material that does not substantially absorb or reflect microwave energy at room temperature or at any temperature less than a maximum sintering temperature of the ceramic member to be sintered, and the thermal containment unit has an inner surface and an outer surface defining a thermal containment chamber. The system also includes at least one susceptor provided within the thermal containment chamber of the thermal containment unit. The susceptor comprises a hollow member and a substance contained within the hollow member that substantially immediately couples to microwave energy at room temperature and emits radiant energy substantially immediately. Preferably, the hollow member comprises a heat resistant ceramic envelope made of a material that does not substantially absorb or reflect microwave energy at room temperature. When the microwave chamber is irradiated with microwave energy from the microwave source, the substance contained within the hollow member of the susceptor substantially immediately couples to the microwave energy such that the susceptor emits radiant energy substantially immediately and the temperature of a ceramic member to be sintered positioned within the thermal containment chamber is raised via the radiant energy emitted from the susceptor to a microwave coupling-trigger temperature of the ceramic member, at which time the ceramic member directly couples to the microwave energy and begins sintering by the microwave energy in cooperation with the radiant energy emitted from the susceptor.

Preferably, the thermal containment unit comprises at least one material selected from the group consisting of silica, boron nitride and alumina. More preferably, the thermal containment unit comprises fibrous alumina or foam silica.

It is also preferred to use a plurality of susceptors and a substantially cylindrical thermal containment unit. The plurality of susceptors are preferably arranged at equiangular positions with respect to a central axis of the substantially cylindrical thermal containment unit.

According to another embodiment of the present invention, a continuous microwave hybrid heating system is provided. The continuous microwave hybrid heating system includes a microwave furnace including at least one applicator in communication with at least one microwave source, and the applicator has a microwave chamber lined with a material that reflects microwave energy. At least one thermal containment unit is provided within the microwave chamber of the applicator. The thermal containment unit comprises a material that does not substantially absorb or reflect microwave energy at room temperature or at any temperature less than a maximum sintering temperature of a ceramic member to be sintered, and the thermal containment unit has an inner surface and an outer surface defining a thermal containment chamber. At least one susceptor is provided within the thermal containment chamber of the thermal containment unit. The susceptor comprises a hollow member surrounding a substance that substantially immediately couples to microwave energy at room temperature and emits radiant energy substantially immediately. The continuous microwave hybrid heating system also includes transport means for continually transporting a plurality of thermal containment units through the microwave chamber. The microwave chamber is irradiated with microwave energy from the microwave source, the substance contained within the hollow member of the susceptor substantially immediately couples to the microwave energy at room temperature and substantially immediately emits radiant energy so that the temperature of the thermal containment chamber is raised via the radiant energy emitted from the susceptor and such that the ceramic member to be sintered is heated to a microwave coupling-trigger temperature thereof, at which time the ceramic member directly couples to the microwave energy and begins sintering by the microwave energy in cooperation with the radiant energy emitted from the susceptor as the thermal containment unit member is transported though the microwave chamber via the transport means. According to one embodiment, the applicator comprises a plurality of applicators arranged in a predetermined configuration to define a single continuous microwave chamber.

According to yet another embodiment of the present invention, a continuous microwave hybrid heating system is provided. The continuous system includes a microwave furnace including a microwave source and a microwave chamber lined with a material that reflects microwave energy, and at least one thermal containment unit provided within the microwave chamber of the furnace. The thermal containment unit comprises a material that does not substantially absorb or reflect microwave energy at room temperature or at any temperature less than a maximum sintering temperature of the ceramic member to be sintered, and the thermal containment unit has an inner surface and an outer surface defining a thermal containment chamber. The continuous system also includes at least one susceptor provided within the thermal containment chamber of the thermal containment unit. The susceptor comprises a hollow member and a substance contained within the hollow member. The substance comprises a material that substantially immediately couples to microwave energy at room temperature and emits radiant energy substantially immediately. The continuous system further includes transport means for continually transporting one or more ceramic members to be sintered through the thermal containment chamber. The microwave chamber is irradiated with microwave energy from the microwave source, the substance contained within the hollow member of the susceptor substantially immediately couples to the microwave energy at room temperature and substantially immediately emits radiant energy so that the temperature of the thermal containment chamber is raised via the radiant energy emitted from the susceptor and such that the ceramic members to be sintered are heated to a microwave coupling-trigger temperature thereof, at which time the ceramic members directly couple to the microwave energy and begin sintering by the microwave energy in cooperation with the radiant energy emitted from the susceptor as the ceramic members are transported though the thermal containment chamber via the transport means. According to one embodiment, the thermal containment unit comprises a plurality of thermal containment units arranged in a predetermined configuration to define a single continuous thermal containment chamber.

BRIEF DESCRIPTION OF THE DRAWINGS

For a more complete understanding of the nature and objects of the present invention, reference should be made to the following detailed description of a preferred mode for practicing the present invention, read in connection with the accompanying drawings, in which:

FIGS. 3A–3C are partial cross-sectional views showing a method for sintering a ceramic material using a MHH system according to one embodiment of the present invention.

DETAILED DESCRIPTION OF THE INVENTION

Figure 1:
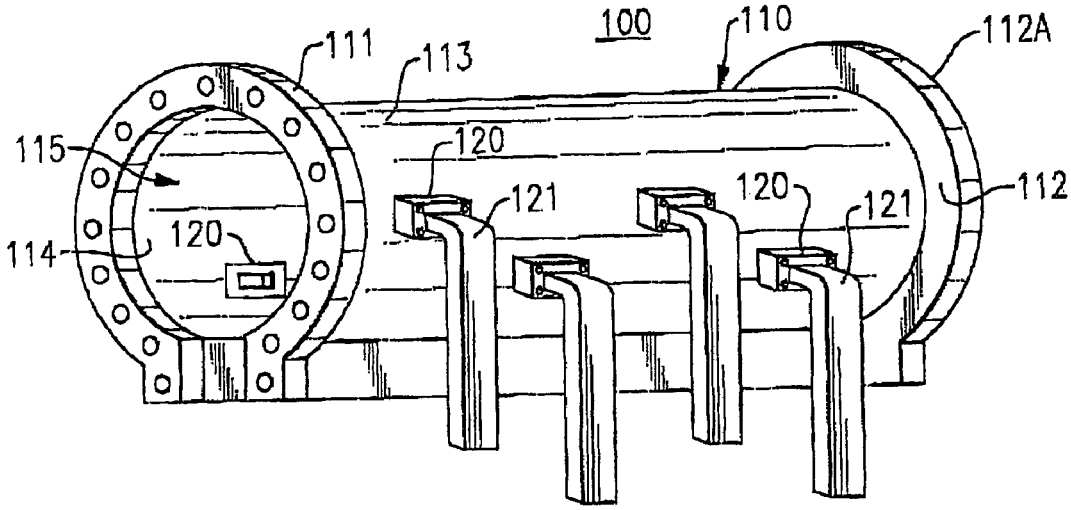
FIG. 1 is a perspective view of an applicator for a microwave hybrid heating system according to one embodiment of the present invention.

FIG. 1 is a perspective end view of an applicator 110 for a microwave hybrid heating system 100 according to one embodiment of the present invention. The applicator 110 is preferably made from a material that is reflective to microwaves and has a substantially cylindrical configuration with a flattened portion for stability and support. The applicator 110 extends in a longitudinal direction from a first end 111 to an opposed second end 112 and has an outer surface 113 and an inner surface 114 to define an elongate microwave chamber 115. The flattened portion provides a stable setting surface for loads (materials) that are processed within the microwave chamber 115 of the applicator 110, and also allows for the conveyance of materials by a belt or other appropriate transport means along the longitudinal distance between the first end 111 and the second end 112. The first end of the microwave chamber 115 is further defined by the inner surface 111A of a first flanged end cover 111 (not shown) and the second end of the microwave chamber 115 is further defined by the inner surface 112A of the flanged end cover 112.

Microwave energy is provided by one or more microwave energy sources (not shown), such as magnetron sources, which can be either directly incorporated into the structure of the applicator 110 or provided in a distant position.

That is, as shown in FIG. 1, when one or more magnetron sources are provided in a location that is remote with respect to the applicator 110, a plurality of ports 120 are preferably provided on the applicator 110. Each port 120 comprises an opening passing from the outer surface 113 to the inner surface 114 of the applicator 110 to provide access to the microwave chamber 115. A plurality of microwave wave guides 121 are also provided, with each wave guide 121 having a first end configured to mate with a respective ports 120. The second ends of the wave guides 121 are respectively connected to at least one distant magnetron microwave source such that the wave guides 121 direct the microwave energy from the respective microwave source into the microwave chamber 115.

The wave guides 121 preferably comprise a material that is reflective to microwave energy to effectively contain and transport the energy from the source to the microwave chamber 115 without any significant energy loss. As mentioned above, however, the microwave source can also be directly incorporated with the applicator structure to further reduce the potential for energy loss on transfer to the microwave chamber 115.

Figure 2:
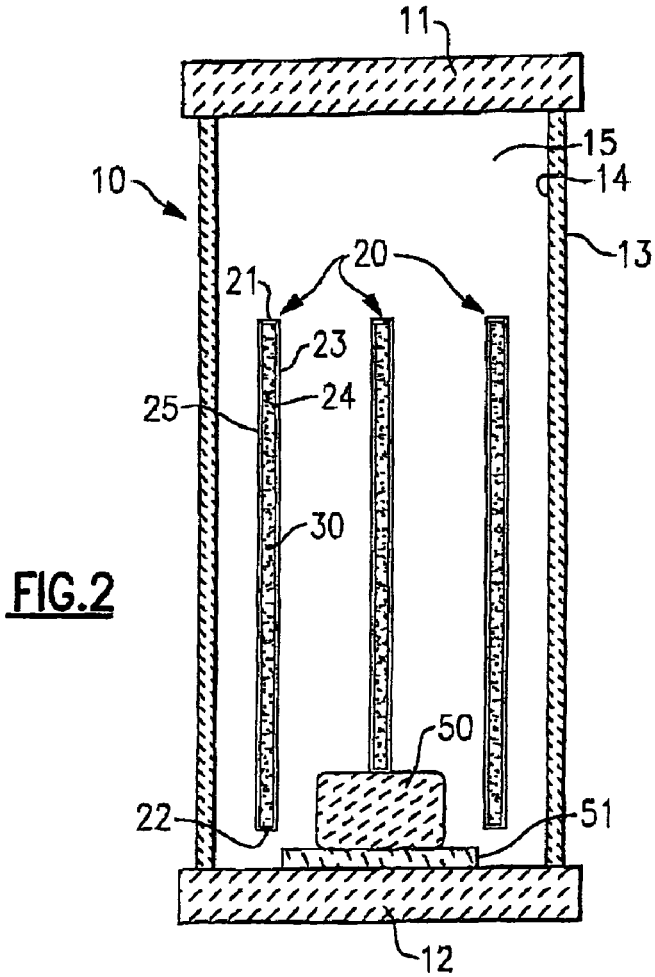
FIG. 2 is a cross-sectional view of a thermal containment unit for a microwave hybrid heating system according to one embodiment of the present invention.

A thermal containment unit, such as the thermal containment unit 10 shown and described in more detail below with respect to FIG. 2, is positioned within the microwave chamber 115 of the applicator 110 to be exposed to the microwaves transported via the wave guides 121 for microwave processing. In a periodic-type sintering system, such as the embodiment shown in FIG. 1, the first end 111 of the applicator 110 is closed off with an end cover 111A (not shown) before the thermal containment unit, including the susceptors and the ceramic member to be sintered positioned within the thermal containment unit, is processed with microwave energy.

As shown in FIG. 2, the thermal containment unit 10 is substantially cylindrical and extends form a first end 11 to an opposed second end 12. Thermal containment unit 10 includes an outer surface 13 and an inner surface 14 defining a thermal containment chamber 15, whose inner peripheral walls correspond to the inner surface 12 of thermal containment unit 10. The first end 11 of the thermal containment unit 10 is open to provide access to the thermal containment chamber 15 and the peripheral edges of the first end 11 are configured to mate with a closing member (not shown), such as a lid made from the same material as that of thermal containment unit 10. The second end 12, or base end as shown, of the thermal containment unit 10 is configured in substantially the same manner as the first end 11, but as shown in FIG. 2, the second end 12 is closed off with a base member 12*a*.

The shape of the thermal containment unit 10 is not limited to the embodiment shown in FIG. 2, and a thermal containment unit having any shape or size that can be sufficiently accommodated within the applicator of the MHH system can be used. Further, while a periodic thermal containment unit 10 is shown in FIG. 2, the thermal containment unit can also be configured to provide a continuous-type sintering system, such as the system described in more detail below with respect to FIG. 4.

The thermal containment unit 10 preferably comprises a heat resistant material that is virtually transparent to microwaves, that is, a material that does not substantially absorb or reflect microwaves at any temperature less than (or equal to) the maximum sintering temperature of the system. Suitable materials for the thermal containment unit 10 include, but are not limited to, boron nitride, foam silica and fibrous alumina.

A plurality of susceptors 20 are also provided within the thermal containment chamber 15 of the thermal containment unit 10. Each susceptor 20 comprises a hollow member having an outer surface 23 and an inner surface 24 extending from a first end 21 to a second end 22 thereof to define a susceptor chamber 25.

The hollow member of the susceptor 20 preferably comprises a heat resistant material, such as a ceramic envelope, that is virtually transparent to microwaves at any temperature less than (or equal to) the maximum sintering temperature of the system. Suitable examples of materials for the hollow members include, but are not limited to, sealed tubes made of quartz, translucent polycrystalline alumina, single crystal magnesium oxide, single crystal sapphire, cubic zirconia and yttrium oxide.

A substance 30 that substantially immediately couples to microwave energy at room temperature and substantially immediately emits radiant energy is provided within the susceptor chamber 25. The first and second ends 21, 22 of the hollow member of each susceptor 20 are sealed by any appropriate means such that the substance 30 is completely contained within the susceptor chamber 25. The substance 30 is preferably provided in an appropriate volume and pressure state such that the substance will sufficiently interact with the microwave energy to produce a sufficient amount of heat without causing a catastrophic pressure situation (i.e., an explosion).

For example, the substance 30 is preferably a gas or vapor that substantially immediately forms plasma when irradiated with microwave energy. More preferably, the substance is a noble gas, such as xenon. Other suitable examples of the substance include mercury vapor and sodium vapor. The particular volume and pressure of the system contained with the susceptor chamber 25 is application dependent. That is, the specific volume and pressure of the substance 30 required to produce a sufficient amount of plasma to generate a sufficient amount of radiant energy depends, for example, on the size of the susceptor chamber 25, the mass of the load to be sintered, and the specific couple triggering temperature of the load to be sintered.

It is preferred that the susceptors 20 are arranged to substantially surround the load of the material to be sintered within the thermal containment chamber 15 of the thermal containment unit 10, however, the particular configuration is not limited to the structures shown and described herein. For example, a single susceptor may be provided proximate a portion of the peripheral wall 14 of the thermal containment chamber 15. Another example susceptor configuration is shown in FIG. 2, wherein a plurality of susceptors 20 are arranged at equiangular positions about the peripheral wall 14 of the thermal containment chamber 15 with respect to the longitudinal axis of the thermal containment chamber 10 extending from the first end 11 to the second end 12 thereof.

Although it is not shown in the drawings, it is preferred that the susceptors 20 are positioned within the thermal containment chamber 15 in a quasi-free-standing arrangement spaced a distance from, but proximate, the peripheral wall 14. This can be accomplished by using any appropriate means, including, but not limited to, eyelet type stand-offs. The material of the stand-offs is preferably transparent to microwaves and examples of suitable materials include, but are not limited to, quartz, BN, high purity $Al_2O_3$, and refractory metals.

It is also possible to affix the susceptors 20 directly to a portion of the peripheral wall 14 of the thermal containment chamber 15 to create a semi-mechanical engagement between the susceptors 20 and the peripheral wall 14 in a propped configuration by altering the surface structure of the peripheral wall 14.

Figure 3C:
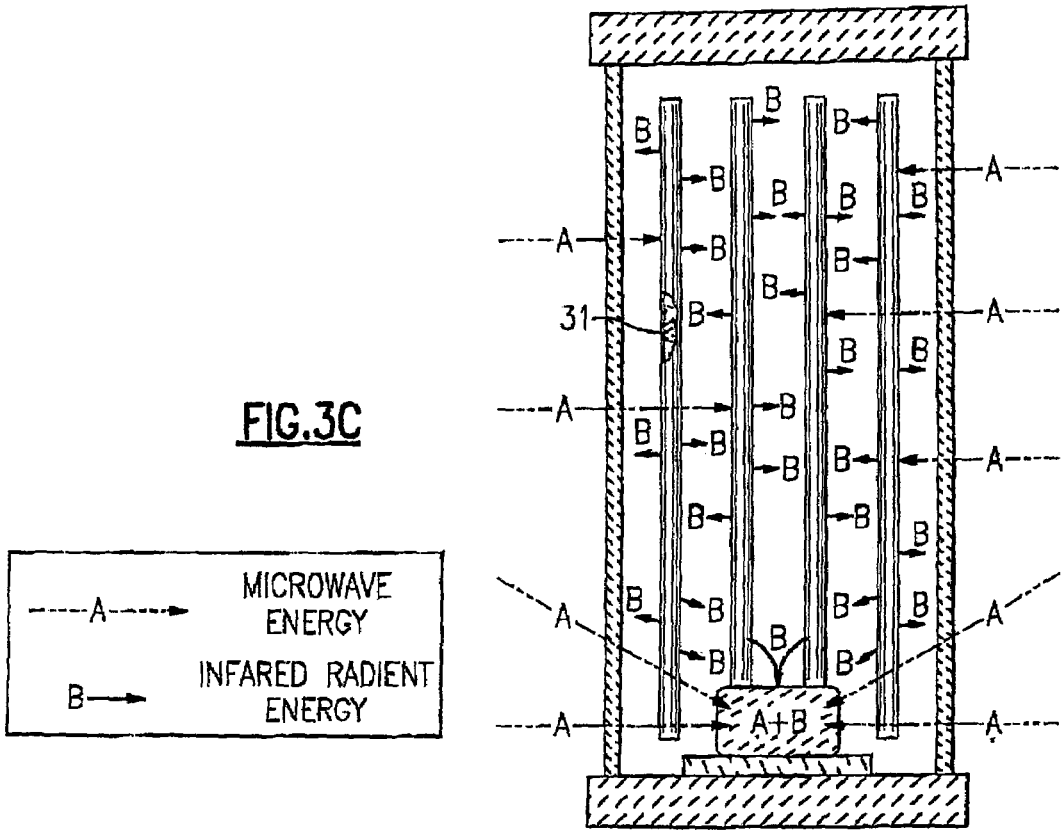

FIGS. 3A–3C show a method for sintering a ceramic material 50 using a MHH system 100 according to one embodiment of the present invention. As shown in FIG. 3A, a microwave furnace includes an applicator 1 equipped with a microwave source (not shown) and having a microwave chamber 2 lined with a material that reflects microwave energy is provided. A thermal containment unit 10 is provided, and at least one susceptor 20 according to the present invention is positioned within the thermal containment chamber 15 of the thermal containment unit 10. At least one ceramic member 50 to be sintered is positioned within the thermal containment chamber 15 of the thermal containment unit 10, either on a setter 51 as shown or directly on a portion of the inner surface, such as the base floor 12*a* formed by the second end 12 of the thermal containment unit 10. The thermal containment unit 10 is positioned within the microwave chamber 2 of the microwave furnace 1.

As shown in FIG. 3B, the microwave chamber 2 is irradiated with microwave energy A from the microwave source. The substance 30 contained within the susceptor chamber 25 of the hollow member of the susceptor 20 (see FIG. 3A) substantially immediately couples to the microwave energy A and forms a plasma 31 (see FIG. 3C) that emits radiant energy B substantially immediately. The temperature of the ceramic member 50 within the thermal containment chamber 15 is thus raised via the radiant energy B emitted from the susceptor 20.

As shown in FIG. 3C, once the temperature of the ceramic member 50 is raised to the coupling-trigger temperature, the ceramic member 50 directly couples to the microwave energy A and is sintered via direct interaction with the microwave energy A in cooperation with the radiant energy B emitted from the susceptor 20.

Figure 4:
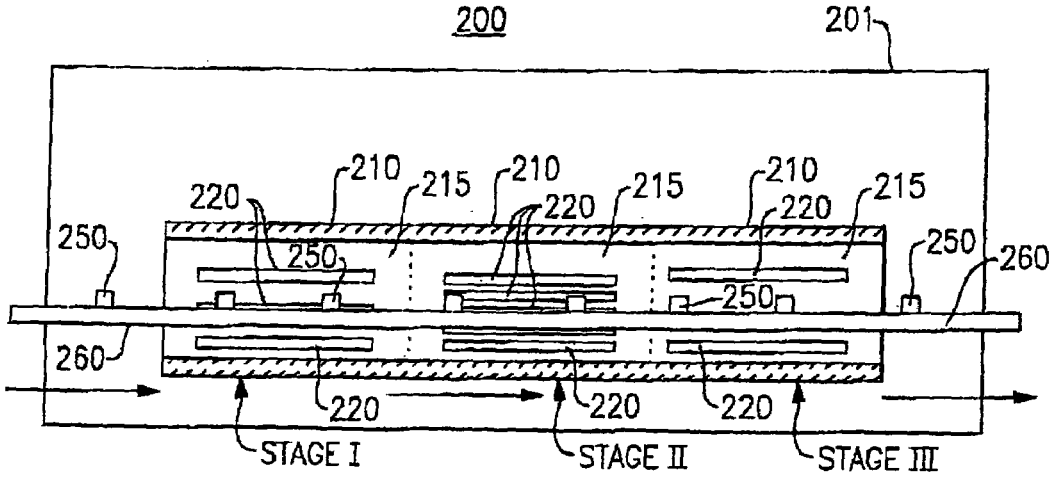
FIG. 4 is a schematic view of a continuous MHH system according to another embodiment of the present invention.

FIG. 4 is a schematic view of a continuous MHH system 200 according to another embodiment of the present invention. The continuous MHH system 200 includes microwave furnace applicator 201 configured to provide a microwave chamber 205 that is large enough to house a plurality of stationary thermal containment units 210 arranged in an end-to-end configuration to provide a single, integral and continuous thermal containment chamber 215. The respective first and second ends of the first and last ones of the thermal containment units 210 in the arrangement are open so as to facilitate the integral end-to-end arrangement and continuous sintering operation.

According to the embodiment shown in FIG. 4, transport means 260 is provided for continually transporting a plurality of ceramic members 250 to be sintered through the continuous thermal containment chamber 215. While transport means 260 is shown as a conveyor belt type means in FIG. 4, it should be noted that the structure and configuration of the MHH system 200 is not limited to the structures shown and described herein, and a variety of deviations can be implemented without departing form the spirit of the present invention.

One or more susceptors 220 according to the present invention are provided within the continuous thermal containment chamber 215. The susceptors 220 interact with the microwave energy and emit radiant heat as described above such that the temperature within a corresponding portion of the thermal containment chamber 215 is substantially elevated as each ceramic member 50 to be sintered is transported therethrough. The susceptors 220 can be positioned at varying points along the axial length of the continuous thermal containment chamber 215 so as to provide a pre-heat stage I, a direct and cooperative sintering stage II and a cooling stage III.

In that manner, as the ceramic member 250 to be sintered is transported through the continuous thermal containment chamber 215, the ceramic member 250 is pre-heated in stage I along a portion of the axial length of the continuous thermal containment chamber 215 until the ceramic member is heated to the microwave coupling-trigger temperature of the ceramic material, at which time the ceramic member 250 directly couples to the microwaves and is directly and cooperatively sintered in the direct and cooperative sintering stage II further along a downstream portion of the axial length of the continuous thermal containment chamber 215. A cooling stage III, which either does not include any of the susceptors 220 or includes a fewer number of susceptors 20, may also be provided along a further downstream portion of the length of the continuous thermal containment chamber 215 in this continuous operation.

In a similar continuous MHH system according to another embodiment of the present invention that is not shown in the drawings, the second end 112 of the applicator 110 of FIG. 1 can be joined to a first end 111 of another applicator 110 to provide a continuous microwave sintering system. That is, a plurality of applicators 110 shown in FIG. 1 can be arranged in an end-to-end configuration in conjunction with transport means for continually transporting individual thermal containment units 10 through the continuous microwave chamber 115 for microwave processing. For example, the first end 111 of the first applicator in the arrangement is open to continually receive a plurality of individual thermal containment units 10 into the continuous microwave chamber 115, and the second end 112 of the first applicator is connected to the first end 111 of the next applicator in the arrangement. This configuration is similarly repeated until the desired number of applicators are provided. The second end 112 of the last applicator in the arrangement is also open to allow the microwave-processed thermal containment units (and the ceramic members positioned therein) to exit the continuous microwave chamber 115 of the continuous MHH system via the transport means.

In this embodiment, the number of ports 120 and wave guides 121 can be varied at varying points along the axial length of the applicator arrangement so as to provide a pre-heat zone, a direct a direct and cooperative sintering zone and a cooling stage zone in the continuous microwave chamber 115.

In that manner, as the thermal containment units 10 are transported through the continuous microwave chamber 115, the ceramic members within the thermal containment units 10 are pre-heated as they travel through a first microwave zone along the axial length of the continuous microwave chamber 115. Microwave introduction zones are provided, either as a continuous zone or a plurality of grouped zones, downstream along the axial length of the continuous microwave chamber 115. As the thermal containment units 10 travel along the continuous microwave chamber 115, the temperatures of the ceramic members within the individual thermal containment units 10 increase in response to the radiant thermal energy emitted from the susceptors that are also within the thermal containment units 10. When the ceramic members are heated to their respective microwave coupling-trigger temperatures, the ceramic members begin to directly couple to the microwaves. In this zone, the ceramic members are directly and cooperatively sintered as the thermal containment units 10 move further downstream along the axial length of the continuous microwave chamber 115. A cooling zone, that either does not include any ports 120 and wave guides 121 or includes a fewer number of ports 120 and wave guides 121 (for controlled cooling), can also be provided in further downstream portions of the continuous microwave chamber 115 in the continuous operation according to this embodiment of the present invention. In that manner, when the thermal containment units 10 exit the continuous microwave chamber 115, the ceramic members are fully sintered and cooled to a temperature at which they can be further processed (i.e., removed form the thermal containment units manually).

While the present invention has been particularly shown and described with reference to the preferred mode as illustrated in the drawings, it will be understood by one skilled in the art that various changes in detail may be effected therein without departing from the spirit and scope of the invention as defined by the claims.

What is claimed is:

1. A susceptor for a microwave hybrid heating system, said susceptor comprising a hollow member surrounding a gaseous substance that substantially immediately couples to microwave energy at room temperature and substantially immediately forms a plasma that emits radiant energy substantially immediately when said susceptor is irradiated with microwave energy.

2. The susceptor of claim 1, wherein said hollow member comprises a ceramic envelope comprising a heat resistant material that does not substantially absorb or reflect microwave energy at room temperature.

3. The susceptor of claim 2, wherein said ceramic envelope comprises a material selected form the group consisting of quartz, translucent polycrystalline alumina, single crystal magnesium oxide, single crystal sapphire, cubic zirconia and yttrium oxide.

4. The susceptor of claim 1, wherein said gaseous substance comprises a gas having a sufficient volume and a sufficient pressure to ensure sufficient plasma formation and sufficient radiant energy emission.

5. The susceptor of claim 4, wherein said gas comprises mercury vapor.

6. The susceptor of claim 4, wherein said gas comprises sodium vapor.

7. The susceptor of claim 4, wherein said gas comprises a noble gas.

8. The susceptor of claim 7, wherein said noble gas comprises xenon.

9. A method for sintering a ceramic member using microwave hybrid heating system comprising the steps of:

(a) providing at least one ceramic member to be sintered, said at least one ceramic member comprising a material having a microwave coupling-trigger temperature greater than room temperature;

(b) providing a microwave furnace including an applicator in communication with at least one microwave source, said applicator having a microwave chamber lined with a material that reflects microwave energy;

(c) providing a thermal containment unit comprising a material that does not substantially absorb or reflect microwave energy at room temperature or at any temperature less than a maximum sintering temperature of said at least one ceramic member to be sintered, said thermal containment unit having an inner surface and an outer surface defining a thermal containment chamber;

(d) providing at least one susceptor, said at least one susceptor comprising a hollow member surrounding a gaseous substance that substantially immediately couples to microwave energy at room temperature and substantially immediately forms a plasma that emits radiant energy substantially immediately when said at least one susceptor is irradiated with microwave energy;

(e) positioning said at least one susceptor within said thermal containment chamber of said thermal containment unit;

(f) positioning said at least one ceramic member to be sintered within said thermal containment chamber of said thermal containment unit;

(g) positioning said thermal containment unit within said microwave chamber of said applicator, (h) irradiating said microwave chamber with microwave energy from said at least one microwave source; and (i) sintering said ceramic member;

wherein said gaseous substance contained within said hollow member of said at least one susceptor substantially immediately couples to the microwave energy and substantially immediately forms a plasma that emits radiant energy substantially immediately such that said at least one susceptor emits the radiant energy substantially immediately and the temperature of said at least one ceramic member within said thermal containment chamber is raised via the radiant energy emitted from said at least one susceptor to said microwave coupling-trigger temperature of said at least one ceramic member, at which time said at least one ceramic member directly couples to the microwave energy such that said ceramic member is sintered by the microwave energy in cooperation with the radiant energy emitted from said at least one susceptor.

10. The method of claim 9, wherein a plurality of said at least one susceptors are provided in step (d) and positioned adjacent and proximate peripheral portions of said inner peripheral surface of said thermal containment unit in step (e) so as to substantially peripherally surround said at least one ceramic member when said at least one ceramic member is provided in step (f).

11. A microwave hybrid heating system comprising:

a microwave furnace including an applicator in communication with at least one microwave source, said applicator having a microwave chamber lined with a material that reflects microwave energy;

a thermal containment unit provided within said microwave chamber, said thermal containment unit comprising a material that does not substantially absorb or reflect microwave energy at room temperature or at any temperature less than a maximum sintering temperature of a ceramic member to be sintered, said thermal containment unit having an inner surface and an outer surface defining a thermal containment chamber; and at least one susceptor provided within said thermal containment chamber of said thermal containment unit, said at least one susceptor comprising a hollow member surrounding a gaseous substance that substantially immediately couples to microwave energy at room temperature and substantially immediately forms a plasma that emits radiant energy substantially immediately when said at least one susceptor is irradiated with microwave energy;

wherein when said microwave chamber is irradiated with microwave energy from said at least one microwave source, said gaseous substance contained within said hollow member of said at least one susceptor substantially immediately couples to the microwave energy and substantially immediately forms a plasma such that said at least one susceptor emits the radiant energy substantially immediately and the temperature of the ceramic member to be sintered positioned within said thermal containment chamber is raised via the radiant energy emitted from said at least one susceptor to a microwave coupling-trigger temperature of the ceramic member, at which time the ceramic member directly couples to the microwave energy and begins sintering by the microwave energy in cooperation with the radiant energy emitted from said at least one susceptor.

12. The microwave hybrid heating system of claim 11, wherein said hollow member comprises a ceramic envelope comprising a heat resistant material that does not substantially absorb or reflect microwave energy at room temperature.

13. The microwave hybrid heating system of claim 12, wherein said ceramic envelope comprises a material selected form the group consisting of quartz, translucent polycrystalline alumina, single crystal magnesium oxide, single crystal sapphire, cubic zirconia and yttrium oxide.

14. The microwave hybrid heating system of claim 11, wherein said gaseous substance comprises a gas having a sufficient volume and a sufficient pressure to ensure sufficient plasma formation and sufficient radiant energy emission.

15. The microwave hybrid heating system of claim 14, wherein said gas comprises mercury vapor.

16. The microwave hybrid heating system of claim 14, wherein said gas comprises sodium vapor.

17. The microwave hybrid heating system of claim 14, wherein said gas comprises a noble gas.

18. The microwave hybrid heating system of claim 17, wherein said noble gas comprises xenon.

19. The microwave hybrid heating system of claim 11, wherein said thermal containment unit comprises at least one material selected from the group consisting of silica, boron nitride and alumina.

20. The microwave hybrid heating system of claim 19, wherein said thermal containment unit comprises fibrous alumina.

21. The microwave hybrid heating system of claim 19, wherein said thermal containment unit comprises foam silica.

22. The microwave hybrid heating system of claim 11, wherein said at least one susceptor comprises a plurality of said susceptors.

23. The microwave hybrid heating system of claim 22, wherein said thermal containment unit is substantially cylindrical.

24. The microwave hybrid heating system of claim 23, wherein said plurality of susceptors are arranged at equiangular positions with respect to a central axis of said substantially cylindrical thermal containment unit.

25. A microwave hybrid heating system comprising:

a microwave furnace;

a thermal containment unit provided within a microwave chamber of said microwave furnace; and at least one susceptor provided within a thermal containment chamber of said thermal containment unit, said at least one susceptor comprising a hollow member housing a gaseous substance that substantially immediately couples to microwave energy at room temperature to form a plasma that emits radiant energy substantially immediately.

* * * * *